US010326206B2

(12) United States Patent
Girard

(10) Patent No.: US 10,326,206 B2
(45) Date of Patent: Jun. 18, 2019

(54) ANTENNA STRUCTURE WITH DIELECTRIC LOADING

(71) Applicant: THOMSON LICENSING, Issy de Moulineaux (FR)

(72) Inventor: Henri Girard, Indianapolis, IN (US)

(73) Assignee: THOMSON LICENSING, Issy les Moulineaux (FR)

( * ) Notice: Subject to any disclaimer, the term of this patent is extended or adjusted under 35 U.S.C. 154(b) by 61 days.

(21) Appl. No.: 15/124,689

(22) PCT Filed: Mar. 20, 2015

(86) PCT No.: PCT/US2015/021712

§ 371 (c)(1),
(2) Date: Sep. 9, 2016

(87) PCT Pub. No.: WO2015/148298

PCT Pub. Date: Oct. 1, 2015

(65) Prior Publication Data

US 2017/0085000 A1 Mar. 23, 2017

Related U.S. Application Data

(60) Provisional application No. 61/970,432, filed on Mar. 26, 2014.

(51) Int. Cl.
*H01Q 9/04* (2006.01)
*H01Q 1/38* (2006.01)
(Continued)

(52) U.S. Cl.
CPC ..... *H01Q 9/0485* (2013.01); *H01Q 1/38* (2013.01); *H01Q 1/48* (2013.01); *H01Q 9/0421* (2013.01); *H01Q 9/42* (2013.01); *H01Q 1/243* (2013.01)

(58) Field of Classification Search
CPC ..... H01Q 1/243; H01Q 1/38; H01Q 9/42; H01Q 1/48
See application file for complete search history.

(56) References Cited

U.S. PATENT DOCUMENTS 7,796,085 B2 9/2010 Fujii
2002/0024466 A1 2/2002 Masuda
(Continued)

FOREIGN PATENT DOCUMENTS

JP 09270618 A * 10/1997
KR 2009107154 A 10/2009
(Continued)

OTHER PUBLICATIONS

Azad et al. "A New Class of Miniature Embedded inverted-F Antennas (IFAs) for 2.4 GHz WLAN Application", IEEE Transactions on Antennas and Propagation, vol. 54, No. 9, Sep. 2006.
(Continued)

*Primary Examiner* — Dieu Hien T Duong
(74) *Attorney, Agent, or Firm* — Tutunjian & Bitetto, P.C.

(57) ABSTRACT

An antenna structure is described. The antenna structure includes a first set of conductive elements that form a first portion of the antenna structure, the first set of conductive elements being formed on a first layer of a multi-layer printed circuit board, and a second set of conductive elements that form a second portion of the antenna structure, the second set of conductive elements being formed in parallel to the first set of conductive elements on a second layer of the multi-layer printed circuit board, wherein the first layer and the second layer are inner layers of the multilayer printed circuit board. An apparatus that uses the antenna structure is also described.

24 Claims, 9 Drawing Sheets

(51) Int. Cl.

| | |
|---|---|
| ***H01Q 9/42*** | (2006.01) |
| ***H01Q 1/48*** | (2006.01) |
| *H01Q 1/24* | (2006.01) |

(56) References Cited

U.S. PATENT DOCUMENTS

| | | | | |
|---|---|---|---|---|
| 2006/0238420 | A1 | 10/2006 | Jansen | |
| 2010/0289719 | A1* | 11/2010 | Wang | H01Q 1/38 343/895 |
| 2012/0142397 | A1* | 6/2012 | Jordan | G01S 5/02 455/556.1 |
| 2012/0319911 | A1 | 12/2012 | Chou | |
| 2013/0093642 | A1 | 4/2013 | Kurashima et al. | |

FOREIGN PATENT DOCUMENTS

| | | | |
|---|---|---|---|
| KR | 1039697 | B1 | 6/2011 |
| WO | WO2011/089141 | A2 | 7/2011 |
| WO | WO2012/013998 | A1 | 2/2012 |

OTHER PUBLICATIONS

International Search Report dated Jun. 10, 2015.

* cited by examiner

ANTENNA STRUCTURE WITH DIELECTRIC LOADING

This application claims the benefit, under 35 U.S.C. § 365 of International Application PCT/US2015/021712, filed Mar. 20, 2015, which was published in accordance with PCT Article 21(2) on Oct. 1, 2015 in English and which claims the benefit of U.S. Provisional Application Ser. No. 61/970,432, filed Mar. 26, 2014, which is incorporated by reference herein in its entirety.

TECHNICAL FIELD OF THE INVENTION

The present disclosure generally relates to an antenna structure and, more specifically, to an antenna structure that includes dielectric loading.

BACKGROUND OF THE INVENTION

This section is intended to introduce the reader to various aspects of art, which may be related to the present embodiments that are described below. This discussion is believed to be helpful in providing the reader with background information to facilitate a better understanding of the various aspects of the present disclosure. Accordingly, it should be understood that these statements are to be read in this light.

Wireless communication networks are present in many communication systems today. Many of the communication devices used in the systems include one or more antennas for interfacing to the network. These communication devices often include, but are not limited to, set-top boxes, gateways, cellular or wireless telephones, televisions, home computers, media content players, and the like. Further, many of these communication devices may include multiple interfaces for different types of networks. As a result, one or more antennas may be present on or in a communication device.

As communication devices continue to get smaller in size, the space allocated in a communication device for communication circuitry, including the antenna(s), may also be reduced. The size or space required for an antenna may vary depending on a number of factors, including the communication network and the choice of antenna type used. One particular operational scenario involves using an inverted f antenna in a 2.4 gigahertz (GHz) home wireless network. FIGS. 1A-1C illustrate an exemplary inverted f antenna design incorporated onto a printed circuit board located inside a communication device. The inverted f antenna uses the top and bottom conductive copper layers of a multilayer printed circuit board. The conductive copper layers are joined together with interlayer vias to form the elements of the antenna.

FIG. 1A includes a conductive element 105. Element 105 operates with similar characteristics to a monopole antenna over a ground plane. One end of element 115 connects to element 105 at a point that is a predetermined distance from one end of element 105. The other end of element 115 connects to element 120. Element 120 is the interface point to an electrical circuit, such as the connection point to a communication circuit. The length of element 105 is selected to be approximately one quarter wavelength of the operating frequency of the antenna. The distance from the end of element 105 to the connection point with element 115 is chosen such that the radiation resistance is as close as possible to the operating impedance or resistance for the communication circuit connected to element 120. The end of element 105 closest to element 115 is connected to one end of another conductive element 110. The other end of element 110 is further connected to a conductive copper ground plane 125. The addition of element 110 is important to the structure of an inverted f antenna. Since the antenna length is usually selected to be less than a full wavelength of the operating frequency for the antenna, the electrical interface for the antenna may electrically operate equivalent to a resistive element in series with a low value capacitive element. Element 110 electrically operates similar to adding an inductor in parallel with the remaining equivalent elements in the antenna. As a result, element 110 reduces the effect of the equivalent series capacitance for the antenna. Although the addition of series capacitance may be used to reduce the size of the antenna, the position and amount of additional series capacitance may also lead to undesirable effects, including a degradation in antenna impedance or resistance and a degradation in antenna radiation pattern.

FIG. 1B includes a mirror image of the elements 105, 110, and 125, labeled 106, 111, and 126 respectively. FIG. 1*b* does not include elements 115 and 120. The mirrored elements 105, 106, 110, and 111 in FIG. 1A and FIG. 1A are connected together using vias 130*a-n*. The mirrored ground planes 125 and 126 in FIG. 1A and FIG. 1B are connected together using vias 135*a-n*. The vias 130*a-n* and 135*a-n* are spaced at a small fraction of the wavelength for the operating or resonant frequency of the antenna. As a result, the mirrored sets of elements effectively act and operate as a single set of elements. The other ends of elements 105 and 106 are left open or not connected. These ends of elements 105 and 106 are also maintained at a distance from the conductive ground planes 125 and 126 such that any undesired or stray capacitance is kept to a minimum in order to have a negligible effect on the tuned or resonant frequency of the antenna.

FIG. 1C shows a three-dimensional view of the elements described for FIG. 1A and FIG. 1B.

A printed circuit board antenna, such as the inverted f antenna described in FIGS. 1A-1C, additionally relies on characteristics associated with elements and materials around the antenna in order to determine the relationship between antenna physical parameters and antenna electrical operation parameters. Physical parameters, including the size, thickness, and length of the elements, along with conductivities and dielectric constants for materials used with the antenna, determine the electrical operating frequency for the antenna. The antenna in FIGS. 1A-1C relies on the dielectric constant value associated with air (e.g., a dielectric constant value equal to one) as one of the physical parameters to determine the electrical parameters and, as a result, determine the physical parameters for, or size of, the constructed antenna. However, an antenna with small physical parameters is desirable given the ever increasing constraints on space in a device, as described earlier. Therefore, there is a need to develop a printed circuit board antenna that is smaller in physical size than conventional printed circuit board antennas while maintaining the same or similar electrical operating parameters.

SUMMARY

According to an aspect of the present disclosure, an antenna structure is described. The antenna structure includes a first set of conductive elements that form a first portion of the antenna structure, the first set of conductive elements being formed on a first layer of a multi-layer printed circuit board, and a second set of conductive elements that form a second portion of the antenna structure, the second set of conductive elements being formed in parallel to the first set of conductive elements on a second layer of the multi-layer printed circuit board, wherein the first layer and the second layer are inner layers of the multilayer printed circuit board.

According to another aspect of the present disclosure, a communication apparatus is described. The communication apparatus includes a circuit capable of at least one of transmitting and receiving a signal, and an antenna coupled to the circuit. The antenna further includes a first set of conductive elements that form a first portion of the antenna structure on a first layer of a multi-layer printed circuit board and a second set of conductive elements that form a second portion of the antenna structure on a second layer of the multi-layer printed circuit board. The second set of conductive elements being formed in parallel with the first set of conductive elements, wherein the first layer and the second layer are inner layers of the multi-layer printed circuit board.

BRIEF DESCRIPTION OF THE DRAWINGS

These, and other aspects, features, and advantages of the present disclosure will be described or become apparent from the following detailed description of the preferred embodiments, which is to be read in connection with the accompanying drawings.

Figure 1A:
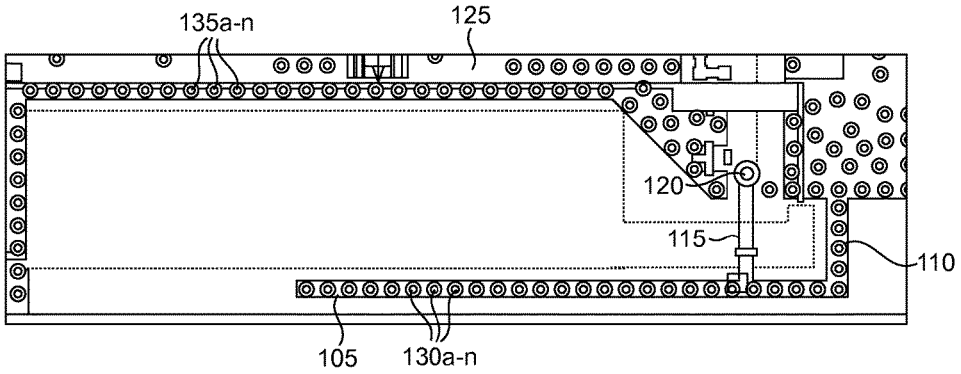
FIG. 1A (PRIOR ART)
FIG. 1A is a diagram of a first view of an exemplary antenna.

It should be understood that the drawing(s) are for purposes of illustrating the concepts of the disclosure and is not necessarily the only possible configuration for illustrating the disclosure, as known by those skilled in the art.

DETAILED DESCRIPTION OF PREFERRED EMBODIMENTS

It should be understood that the elements shown in the figures may be implemented in various forms of hardware, software or combinations thereof. Preferably, these elements are implemented in a combination of hardware and software on one or more appropriately programmed general-purpose devices, which may include a processor, memory and input/output interfaces. Herein, the phrase "coupled" is defined to mean directly connected to or indirectly connected with through one or more intermediate components. Such intermediate components may include both hardware and software based components.

The present description illustrates the principles of the present disclosure. It will thus be appreciated that those skilled in the art will be able to devise various arrangements that, although not explicitly described or shown herein, embody the principles of the disclosure and are included within its scope.

All examples and conditional language recited herein are intended for educational purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure. For example, it will be appreciated by those skilled in the art that the diagrams presented herein represent conceptual views of illustrative circuitry and elements embodying the principles of the disclosure The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read only memory (ROM) for storing software, random access memory (RAM), and nonvolatile storage.

The present disclosure is directed at the problems related to reducing the size of an antenna used as part of a communication circuit. As devices that use antennas continue to shrink in size, efficient packaging and construction for components, including antennas, becomes more important. Antenna designs may be limited by constraints and inherent tradeoffs between electrical operating parameters and physical characteristics. The present disclosure attempts to address at least some of these issues.

The embodiments of the present disclosure are related to an antenna that is printed onto or into a printed circuit board and utilizes the printed circuit board material as part of the dielectric element associated with the electrical properties for the antenna in order to reduce the physical size of the antenna. The antenna places the conductive elements for the antenna in parallel on inner layers of the circuit board with the conductive elements connected together using vias in the circuit board. A printed circuit board structure is described in conjunction with the antenna. In the printed circuit board structure, four copper surfaces, or layers, are sandwiched around three material regions. The first and second layers are inner layers surrounded by material, while the third and fourth layers are the top and bottom layers of the printed circuit board structure. As a result, the antenna structure is located within the material used for the printed circuit board.

Based on the structure for the embodiments, the radiation field for the antenna passes symmetrically through the printed circuit board material prior to passing into the air. The dielectric constant for the printed circuit board material is larger or greater than the dielectric constant for air. The higher dielectric constant produces a change in the relationship between the electrical properties and the physical properties for the antenna resulting in a reduced physical size for the antenna while maintaining a similar operating or resonant frequency. In addition, one end of the antenna may be capacitively coupled, or loaded, to the ground plane using the circuit board material as a dielectric in order to further reduce the size of the antenna.

Described herein are mechanisms for implementing one or more antennas in a communication device. In particular, the mechanisms are described with respect to an inverted f antenna. It is important to note that the mechanisms may be adapted for use in other antenna designs, particularly those that may traditionally be designed to operate at frequencies associated with air dielectric interface designs implemented on a printed circuit board. The mechanisms are further useful with antenna designs at frequencies below the frequency range for which microstrip or patch antennas may be practical (e.g, frequencies below 2.5 GHz). For instance, with only minor modifications, the embodiments described below could be modified to work with a dipole antenna included in or with a communication device.

Figure 2:
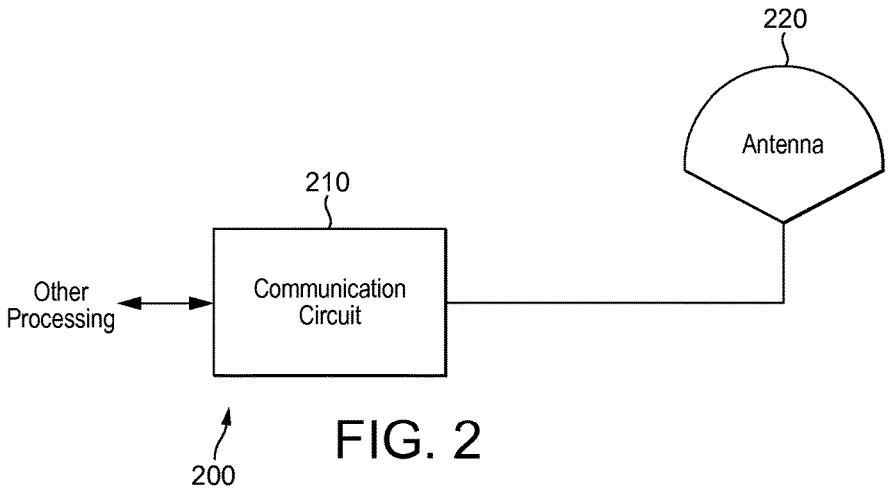
FIG. 2 is a block diagram of an exemplary communication device in accordance with aspects of the present disclosure.

Turning now to FIG. 2, a block diagram of an embodiment of a communication device 200 according to aspects of the present disclosure is shown. Communication device 200 may be used as part of a communication receiver, transmitter, and/or transceiver device including, but not limited to, a handheld radio, a set-top box, a gateway, a modem, a cellular or wireless telephone, a television, a home computer, a tablet, and a media content player. Communication device 200 may include one or more interfaces to wireless networks including, but not limited to, Wi-Fi, Institute of Electrical and Electronics Engineers (IEEE) standard 802.11 or other similar wireless communication protocols. It is important to note that several components and interconnections necessary for complete operation of communication device 200, either as a standalone device, or incorporated as part of another device, are not shown in the interest of conciseness, as the components not shown are well known to those skilled in the art.

Communication device 200 includes a communication circuit 210 that interfaces with other processing circuits, such as a content source and/or a content playback device, not shown. Communication circuit 210 connects to antenna 220. Antenna 220 provides the interface to the airwaves for transmission and reception of signals to and from communication device 200.

Communication circuit 210 includes circuitry for improving transmission and reception of a signal interfaced through antenna 220 to another device over a wireless network. A received signal from antenna 220 may be amplified by a low noise amplifier and tuned by a set of filters, mixers, and oscillators. The tuned signal may be digitized and further demodulated and decoded. The decoded signal may be provided to other processing circuits. Additionally, communication circuit 210 generates, converts, and/or formats an input signal (e.g., an audio, video, or data signal) from the other processing circuits for transmission through antenna 220. Communication circuit 210 may include a power amplifier for increasing the transmitted signal level of the signal sent from communication device 200 over the wireless network. Adjustment of the amplification applied to a signal received from antenna 220 as well as amplification for a signal transmitted by antenna 220 may be controlled by a circuit in communication circuit 210 or may be controlled by other processing circuits.

Communication circuit 210 also includes interfaces to send and receive data (e.g., audio and/or video signals) to other processing circuits (not shown). Communication circuit 200 further amplifies and processes the data in order to either provide the data to antenna 220 for transmission or to provide the data to the other processing circuits. Communication circuit 210 may receive or send audio, video, and/or data signals, either in an analog or digital signal format. In one embodiment, communication circuit 210 has an Ethernet interface for communicating data to other processing circuits and an orthogonal frequency division multiplexing (OFDM) interface for communicating with antenna 220. Communication circuit 210 includes processing circuits for converting signals between Ethernet format and OFDM format.

Antenna 220 interfaces signals between communication circuit 210 and the wireless network. In a preferred embodiment, antenna 220 is an inverted f antenna and is further incorporated into a printed circuit board, such as the printed circuit board used for communication circuit 210. The antenna uses pairs of conductive elements located on inner layers of the printed circuit board. The pairs of elements are connected together using vias in the printed circuit board allowing each pairs of elements to operate as one element. Further details regarding an antenna, such as antenna 220, will be described below.

It is important to note that more than one antenna 220 may be used in communication device 200. The use of more than one antenna provides additional performance capability and control options. For example, in one embodiment, a first antenna may be oriented in a first orientation or axis with a second antenna oriented in a second orientation or axis. In another embodiment, two antennas may be spaced physically at opposite ends of communication device 200 or a larger device that includes communication device 200. The use of multiple antennas in embodiments as described herein permit such performance improvements as orientation control, diversity transmission or reception, antenna steering, and multiple input multiple output signal transmission and reception.

Communication device 200 in FIG. 2 is described primarily as operating with a local wireless network, such as WiFi or IEEE 802.11. It should be appreciated by one skilled in the art that other network standards that incorporate a wireless physical interface may be used. For instance, communication device 200 may easily be used with a Bluetooth network, a WiMax network, or any number of cellular phone network protocols. Further, more than two networks may be used either alternatively or simultaneously together.

Figure 3:
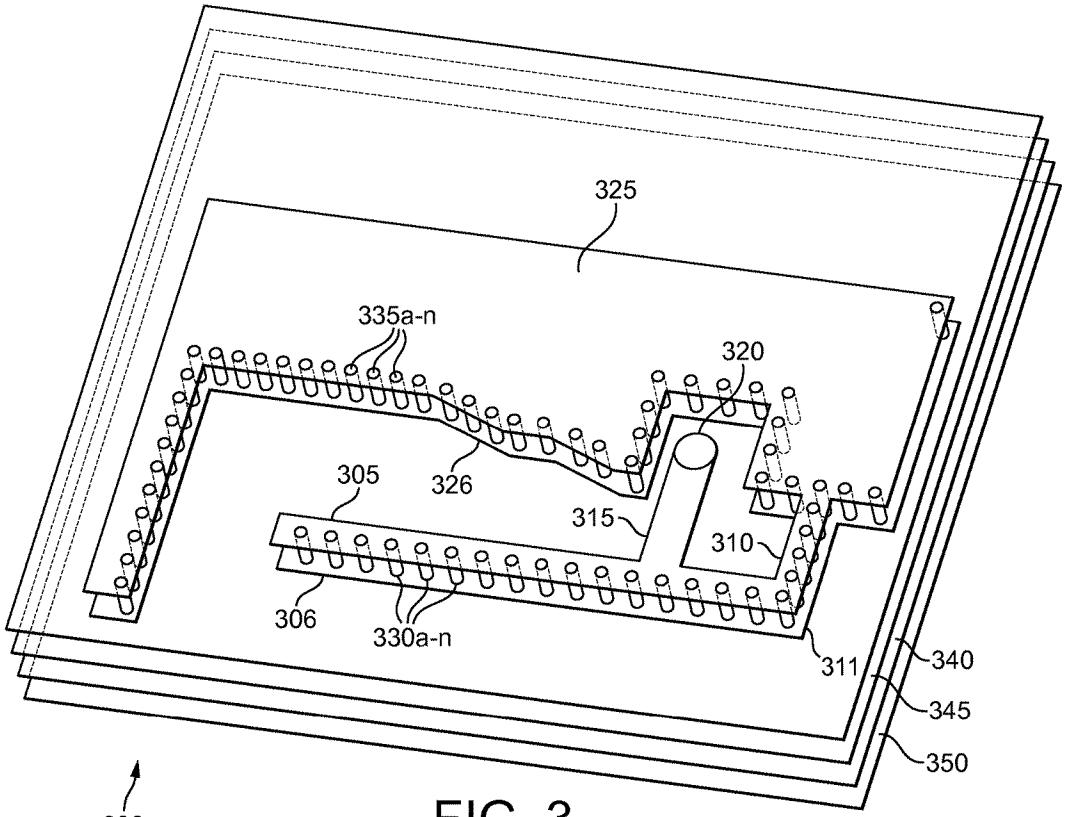
FIG. 3 is a three dimensional diagram of an exemplary antenna in accordance with aspects the present disclosure.

Turning now to FIG. 3, a three dimensional diagram of an exemplary antenna 300 using aspects of the present disclosure is shown. Antenna 300 may be used as part of a communication device, such as communication device 200 described in FIG. 2. Further, antenna 300 may be included a larger multifunction device, such as, but not limited to a handheld radio, a set-top box, a gateway, a modem, a cellular or wireless telephone, a televisions, a home computer, a tablet, and a media content player.

Figure 1B:
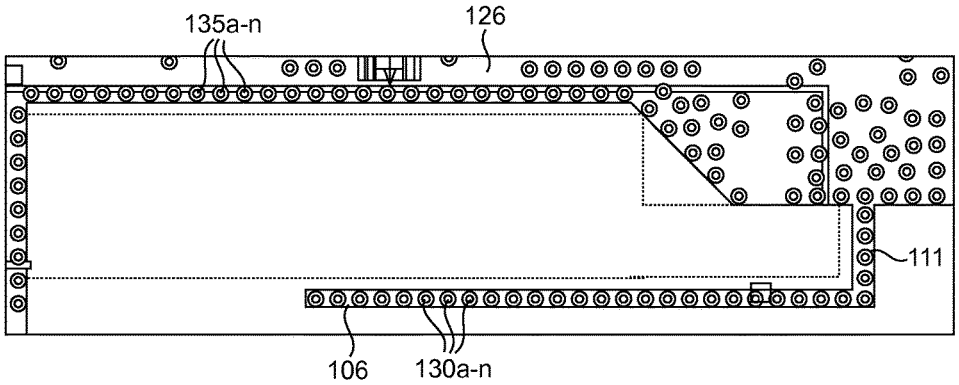
FIG. 1B (PRIOR ART)
FIG. 1B is a diagram of a second view of an exemplary antenna.
Figure 1C:
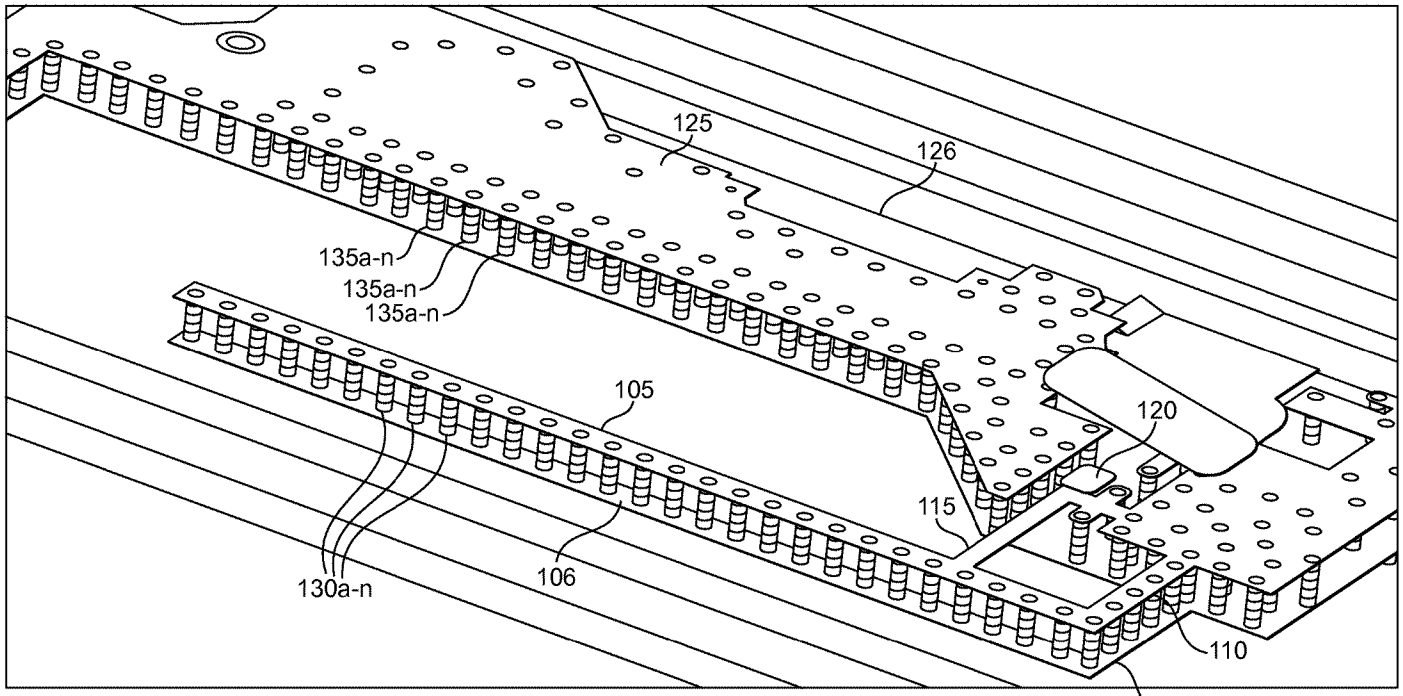
FIG. 1C (PRIOR ART)
FIG. 1C is a diagram of a third view of an exemplary antenna.

Antenna 300 includes conductive elements 305 and 306. Element 306 connects to element 320 through conductive element 315 at a point nearer to one of the ends of element 305. The ends of element 305 and element 306 closest to element 315 are connected to one end of conductive elements 310 and 311 respectively. The other ends of elements 310 and 311 are further connected to ground planes 325 and 326 respectively. The elements 305 and 306, and 310 and 311 are connected together using vias 330*a-n*. The physical area between elements 305 and 306, 310 and 311, and 325 and 326 is occupied by material 340. The physical area immediately above and below elements 305 and 306, 310 and 311, and 325 and 326 is occupied by material 345 and 350 respectively. Except as described here, the operation of antenna 300, and in particular, elements 305 and 306, 310 and 311, 315, 320, and 325 and 326, is similar to the operation for similar numbered elements described for the antenna in FIG. 1A-1C. Further, material 340, 345, and 350 is shown as transparent in FIG. 3. However, material 340, 345, and/or 350 may be semi-transparent, translucent, opaque, or any light permittivity range in between.

Antenna 300 describes an exemplary inverted f antenna design incorporated into a printed circuit inside a communication device. Unlike previous printed circuit board antennas, such as the antenna described in FIGS. 1A-1C, antenna 300 places the conductive elements within the printed circuit board material and uses interlayer vias to form the elements of the antenna.

Material 340, 345, and 350 is comprised of printed circuit board material. Printed circuit board material typically has a dielectric constant value that is greater than air and is in a range between three and five. In one embodiment, a common printed circuit board material known as FR-4 may be used and has a dielectric constant value equal to 4.5. By immersing or surrounding the conductive elements for antenna 300 in material 345 and 350 having a dielectric constant value greater than air, the electromagnetic wave produced by the radiation pattern of antenna 300 will slow in proportion to the square root of the dielectric constant value. As a result, the wavelength becomes smaller allowing effective physical length of the antenna for the same operating frequency to be reduced by design.

It is not physically possible to immerse the entire near and far electromagnetic radiation field into material 345 and 350 as part of a printed circuit board antenna, such as antenna 300. However, the dielectric loading from material 345 and 350 present in the near radiation field produces a significant and noticeable effect on the resonant frequency for antenna 300. In one embodiment, a thickness equal to 0.025 inches for both material 345 and 350 reduced the resonant frequency for antenna 300 by approximately five percent as compared to without material 345 and 350. The physical length of elements 305 and 306 may be shortened as a result of the dielectric loading in order to return the resonant frequency of antenna 300 to the desired resonant or operating frequency range. An antenna, such as antenna 300, that uses an inner layer implementation for the conductive elements takes less space and is physically smaller in size than a similar structure that uses an outer layer implementation (e.g., the antenna described in FIGS. 1A-1C).

Vias 330*a-n*, along with vias 335*a-n*, are shown as interlayer vias passing through material 340 and also appear at the top and bottom after passing through material 345 and 350. Vias 330*a-n* may provide additional conductive surfaces for radiation by antenna 300. As described earlier, the vias are spaced at a small fraction of the wavelength for the operating frequency for antenna 300 (e.g., one tenth of a wavelength). The small spacing causes the vias to act as if they are continuous and result in additional metal surface area and material thickness for antenna 300. The additional metal surface area reduces resistive losses and improves antenna efficiency. However, the vias passing through material 345 and 350 may also further reduce the size or length of antenna 300. In an alternative embodiment, vias 330*a-n* and/or vias 335*a-n* may only pass through material 340 and not continue through material 345 and 350, however, the added benefit described above may also be reduced using this alternate embodiment. Vias only passing through to connect inner layers and not passing through to the top and bottom surfaces are referred to as blind vias.

Figure 4:
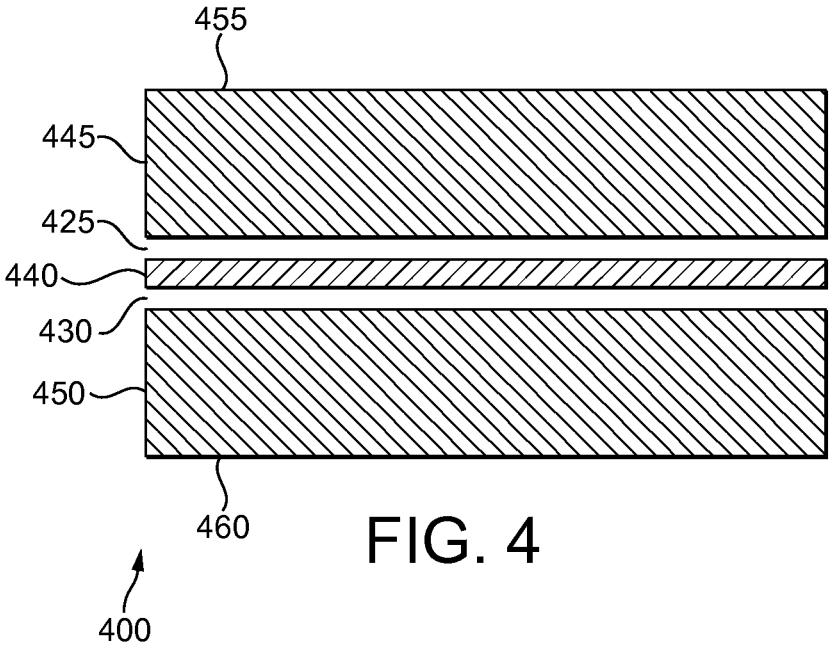
FIG. 4 is a side view diagram of a printed circuit board structure associated with an exemplary antenna in accordance with aspects of the present disclosure.

Turning now to FIG. 4, a diagram of a printed circuit board structure 400 associated with an exemplary antenna in accordance with aspects of the present disclosure is shown. In particular, circuit board structure 400 will be described in relation to antenna 300 described in FIG. 3. The construction and manufacturing processes for printed circuit boards will not be described in detail here as they are well known by those skilled in the art.

Circuit board structure 400 includes a first conductive element region 425 and second conductive region 430 surrounding a material region 440. Additional material regions 445 and 450 are located in the area above conductive region 425 and below conductive region 430 respectively. Further conductive regions, 455 and 460, are located on the top surface of material region 445 and the bottom surface of material region 450 respectively.

Each conductive region 425, 430, 455, and 460 is typically very thin. The conductive material used in conductive regions 425, 430, 455 and 460 is usually copper or a copper alloy. However, other conductive materials, such as silver, platinum, or gold, may be used in pure or alloy form. The material regions 440, 445, and 450 may use a common printed circuit board material, such as FR-4 and the like. The material used in material region 440 may be the same or different than the material used for material regions 445 and 450. Additionally, material region 440 may be the same or a different thickness than material regions 445 and 450. In one embodiment, the thickness for conductive regions 425, 430, 455, and 460 is 0.0025 inches, the thickness for material region 440 is 0.0125 inches, and the thickness for material regions 445 and 450 is 0.025 inches. Other thicknesses may be used. However, it is important to note that the operation of antenna 300 relies on the dielectric constant value for the material in material regions 445 and 450 as well as the thickness of the material. The improvements realized by the principles of the present embodiments will be affected by the thickness of, as well as the dielectric constant value for, the material in material regions 445 and 450.

Further, circuit board structure 400 illustrates a multilayer board including two inner layers as well as two outer layers, known as a four layer board. Other embodiments may utilize more layers. For instance, in another embodiment a circuit board structure may use an eight layer printed circuit board including seven material regions and six conductive regions. In order to maximally benefit from the principles of the present disclosure, the innermost layers or conductive regions of a multilayer board should be used for the conductive elements of the antenna structure.

Figure 5:
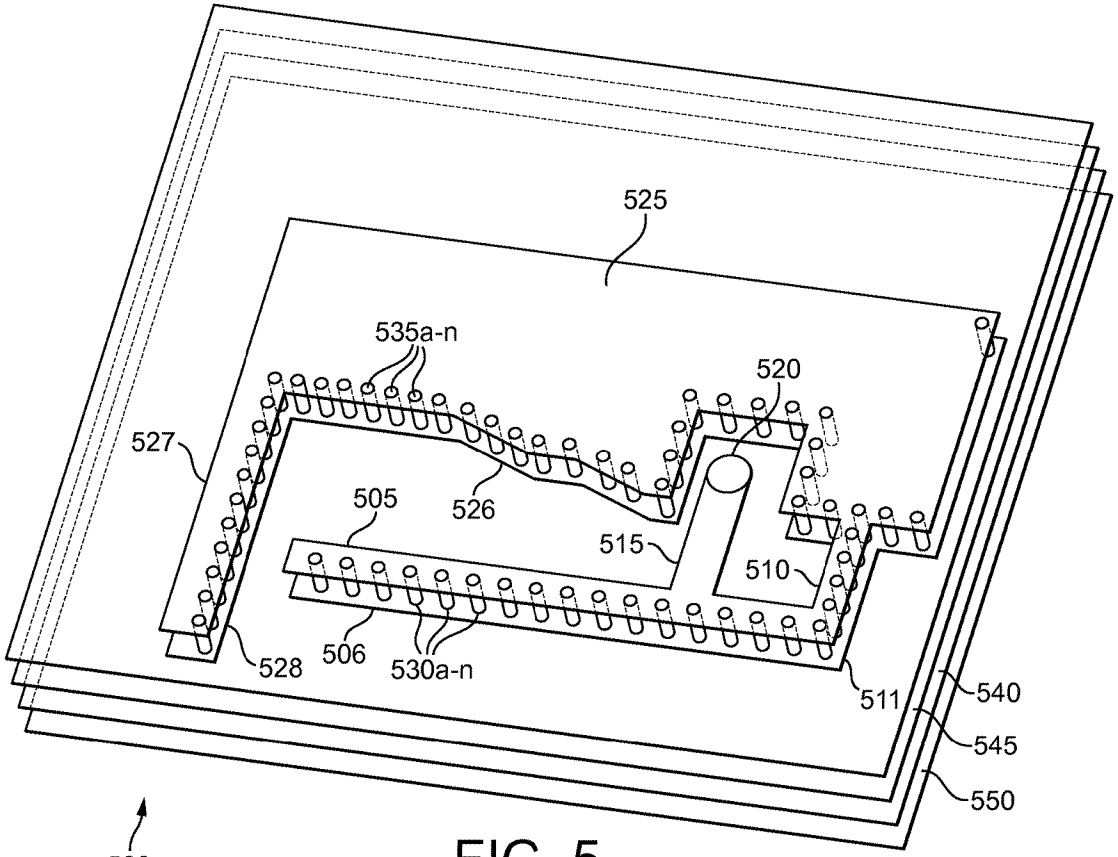
FIG. 5 is a three dimensional diagram of another exemplary antenna in accordance with aspects of the present disclosure.

Turning now to FIG. 5, a three dimensional diagram of another exemplary antenna 500 using aspects of the present disclosure is shown. Antenna 500 may be used as part of a communication device, such as communication device 200 described in FIG. 2. Further, antenna 500 may be included a larger multifunction device, such as, but not limited to a handheld radio, a set-top box, a gateway, a modem, a cellular or wireless telephone, a television, a home computer, a tablet, and a media content player. Except as described here, the elements of antenna 500 are positioned and function in a manner similar to similarly numbered elements described for antenna 300 described in FIG. 3.

Antenna 500 further includes a portion of ground plane 525 and ground plane 526, labeled 527 and 528 respectively. Portions 527 and 528 are located in close proximity to the open or unconnected end of elements 505 and 506 respectively. The configuration in antenna 500 capacitively loads or capacitively couples the ends of elements 505 and 506 to ground at portions 527 and 528. As described above, capacitive loading is normally undesired for operation of the antenna. However, the configuration in antenna 500 produces a capacitive coupling that is concentrated to the ends of elements 505 and 506 and dielectrically loaded through material 540, 545, and 550.

The additional capacitive coupling further lowers the operating or resonant frequency for antenna 500. As a result, the size of antenna 500 may be reduced, primarily by reducing the length of elements 505 and 506. In one embodiment, the length of elements 505 and 506 are reduced to 10.4 millimeters (mm) as compared to an original length of 16.6 mm. In addition, the closer proximity of the ground planes 527 and 528 reduces the overall length of antenna 500 from 26.6 mm to 12.3 mm.

Figure 6:
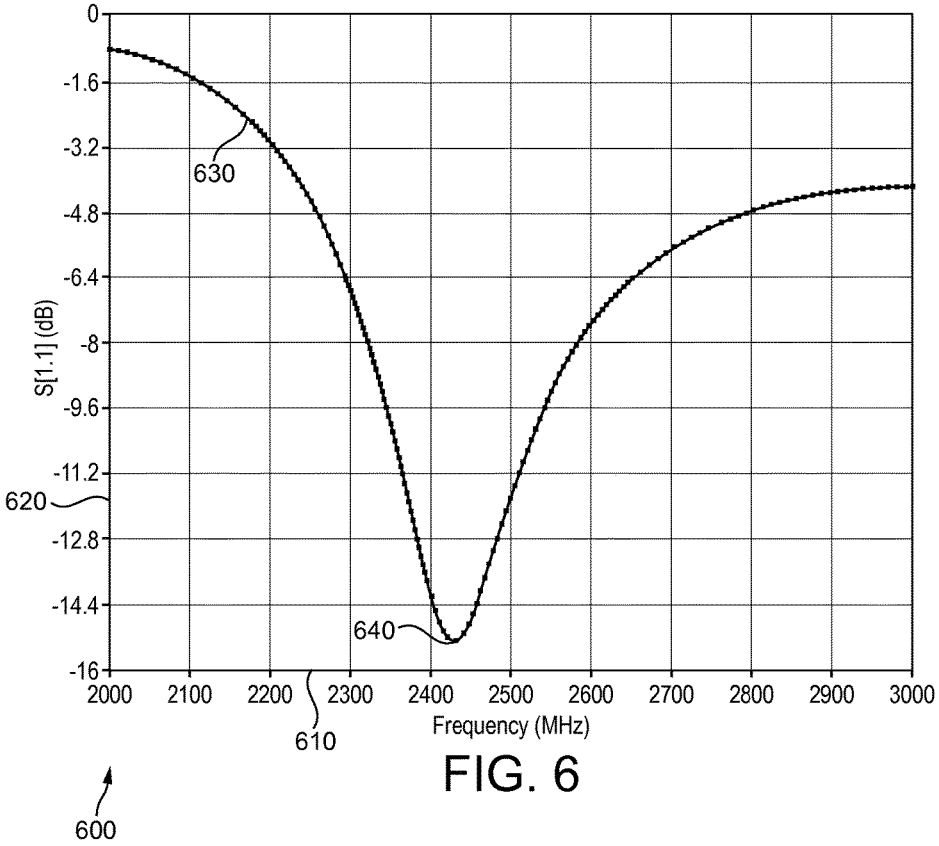
FIG. 6 is a graph illustrating a characteristic of an exemplary antenna in accordance with aspects of the present disclosure.

FIG. 6 illustrates a graph 600 of an electrical characteristic of antenna 500 in accordance with aspects of the present disclosure. Graph 600 represents the scalar value for return loss of antenna 500 versus frequency as measured at the antenna electrical terminal (e.g., element 520). Graph 600 includes an x-axis 610 displaying frequency in megahertz (MHz). Graph 600 also includes a y-axis 620 displaying return loss, displayed as (S1,1), in decibels (dB). Line 630 displays the value of return loss versus frequency for antenna 500. Point 640 displays the minimum value for return loss, representing the best impedance match point between antenna 500 and the expected circuit impedance at element 520.

Figure 7:
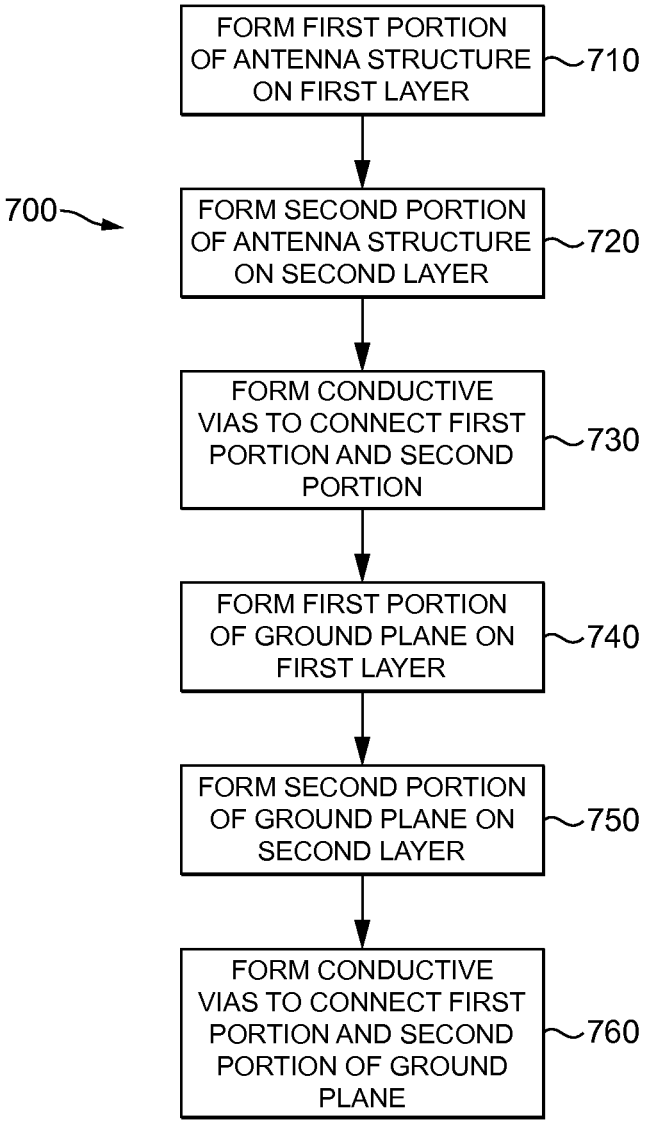
FIG. 7 is a flow chart of an exemplary process for manufacturing an antenna in accordance with aspects of the present disclosure.

Turning now to FIG. 7, a flow chart of an exemplary process 700 for manufacturing an antenna in accordance with aspects of the present disclosure is shown. Process 700 may be incorporated as part of a process for manufacturing an antenna, such as antenna 300 described earlier in FIG. 3 or antenna 300 described earlier in FIG. 5. Process 700 may also be incorporated as part of a process for manufacturing a communication device, such as communication device 200 described in FIG. 2. Process 700 may also rely on certain manufacturing techniques and materials including but not limited to the techniques and materials described in FIG. 4. Specific details regarding certain manufacturing techniques needed for manufacturing antennas and/or devices will not be further described here as they are well known to those skilled in the art.

Process 700 forms an antenna, as part of the manufacturing process, using two inner layers of a printed circuit board. The inner layers are connected through a plurality of conductive via holes or elements, also formed in the manufacturing process. In one embodiment, the antenna formed by process 700 is an inverted F antenna intended to operate at a frequency of 2.5 GHz or lower.

At step 710, a first portion of an antenna structure is formed on a first layer of a multi-layer printed circuit board using a first set of conductive elements. At step 720, a second portion of the antenna structure on a second layer of the multi-layer printed circuit board using a second set of conductive elements. It is important note that the first and second set of conductive elements are formed such that the second set of conductive elements are in parallel with the first set of conductive elements. Next, at step 730, a plurality of conductive via holes or elements are formed to connect the first set of conductive elements to the second set of conductive elements formed at steps 710 and 720. It is important to note that other connecting structures may be used, at step 730, or the connection step 730 may be combined as an inherent part of step 710 and/or step 720.

In some embodiments, process 700 may be continued in order to form an additional structure related to a ground plane for the antenna. The ground plane may reduce the size of the antenna structure when a portion of the first conductive ground plane and a portion of the second conductive ground plane are capacitively coupled to a portion of the first set of conductive elements and a portion of the second set of conductive elements.

At step 740 a first conductive ground plane is formed on the first layer of the multi-layer printed circuit board. At step 750, a second conductive ground plane is formed on the second layer of the multi-layer printed circuit board such that the second conductive ground plane is in parallel with the first conductive ground plane. Last, at step 760, a plurality of conductive via holes or elements are to connect together the first conductive ground plane and the second conductive ground plane. As will step 730 earlier, the connection, at step 760, may be completed through a mechanism other than via connection or step 730 may be incorporated into steps 740 and 750.

The embodiments herein describe an antenna that is printed onto or into a printed circuit board and utilizes the printed circuit board material as part of the dielectric element associated with the electrical properties for the antenna in order to reduce the physical size of the antenna. The antenna is described as being used as part of a communication device. The antenna places the conductive elements for the antenna on inner layers of the circuit board with the conductive elements connected together using vias in the circuit board.

The configuration described in the present embodiments effectively places a dielectric material around the entire conductive surfaces of the antenna. As a result, the radiation field for the antenna passes symmetrically through the printed circuit board material prior to passing into the air. The dielectric constant for the printed circuit board material is larger or greater than the dielectric constant for air. The higher dielectric constant produces a change in the relationship between the electrical properties and the physical properties for the antenna resulting in a reduced physical size for the antenna while maintaining a similar operating or resonant frequency. In addition, one end of the antenna may be capacitively coupled, or loaded, to the ground plane using the circuit board material as a dielectric in order to further reduce the size of the antenna.

Although embodiments which incorporate the teachings of the present disclosure have been shown and described in detail herein, those skilled in the art can readily devise many other varied embodiments that still incorporate these teachings. Having described preferred embodiments of an antenna using dielectric loading (which are intended to be illustrative and not limiting), it is noted that modifications and variations can be made by persons skilled in the art in light of the above teachings. It is therefore to be understood that changes may be made in the embodiments of the disclosure disclosed which are within the scope of the disclosure as outlined by the appended claims.

What is claimed is:

1. An antenna structure comprising:

a multi-layer printed circuit board having first and second inner layers separated by a first material region and third and fourth outer layers separated from the first and second inner layers respectively by second and third material regions, said first and second inner layers being surrounded by a material used in the material regions;

a first set of conductive elements that form a first portion of the antenna structure being formed on the first inner layer and comprising a first radiator arm, a first shorting arm and a feeder arm; and a second set of conductive elements that form a second portion of the antenna structure being formed in parallel to the first set of conductive elements on the second inner layer, said second set of conductive elements comprising a second radiator arm and a second shorting arm, the first set of conductive elements and the second set of conductive elements being included in an inverted f antenna;

a first conductive around plane form on the first later of the multi-layer printed circuit board; and a second conductive around plane formed in parallel with the first conductive around plane on the second layer of the multi-layer printed circuit board, the second conductive around plane and the first conductive around plane being connected together using conductive vias;

wherein a portion of the first conductive around Diane and a portion of the second conductive ground place are capacitively coupled respectively to a portion of the first radiator arm and a portion of the second radiator arm.

2. The antenna structure of claim 1, wherein the second set of conductive elements are formed as a mirror image of the first set of conductive elements.

3. The antenna structure of claim 1, wherein the antenna structure includes conductive vias to connect the first set of conductive elements to the second set of conductive elements.

4. The antenna structure of claim 1, wherein the material regions comprise a base material for the multi-layer printed circuit board, said first set of conductive elements and the second set of conductive elements being integrated within the base material.

5. The antenna structure of claim 4, wherein the base material for the multi-layer printed circuit board has a dielectric constant value that is greater than air.

6. The antenna structure of claim 5, wherein the integration of the first set of conductive elements and the second set of conductive elements within the base material for the multi-layer printed circuit board operates to reduce the physical size of the antenna structure for a given frequency of electrical operation.

7. The antenna structure of claim 1, wherein the capacitive coupling reduces the physical size of the antenna structure for a given frequency of electrical operation.

8. The antenna structure of claim 1, wherein the antenna structure is used at an electrical frequency that is less than or equal to 2.5 gigahertz.

9. A communication apparatus comprising:

a circuit capable of at least one of transmitting and receiving a signal; and an antenna structure coupled to the circuit, the antenna structure comprising:

a multi-layer printed circuit board having first and second inner layers separated by a first material region and third and fourth outer layers separated from the first and second inner layers respectively by second and third material regions, said first and second inner layers being surrounded by a material used in the material regions;

a first set of conductive elements that form a first portion of the antenna structure formed on the first inner layer and comprising a first radiator arm, a first shorting arm and a feeder arm, and a second set of conductive elements that form a second portion of the antenna structure formed on the second inner layer in parallel to the first set of conductive elements, said second set of conductive elements comprising a second radiator arm and a second shorting arm, the first set of conductive elements and the second set of conductive elements being included in an inverted f antenna;

a first conductive around plane formed on the first layer of the multi-layer printed circuit board; and a second conductive ground plane formed on the second layer of the multi-layer printed circuit board in parallel to the first conductive around plane;

wherein the second conductive ground plane and the first conductive ground plane are connected together using conductive vias; and wherein a portion of the first conductive around plane and a portion of the second conductive around plane are capacitively coupled respectively to a portion of the first radiator arm and a portion of the second radiator arm.

10. The communication apparatus of claim 9, wherein the second set of conductive elements are formed as a mirror image of the first set of conductive elements.

11. The communication apparatus of claim 9, wherein the antenna further includes conductive vias to connect the first set of conductive elements to the second set of conductive elements.

12. The communication apparatus of claim 9, wherein the material regions comprise a base material for the multi-layer printed circuit board, said first set of conductive elements and the second set of conductive elements being integrated within the base material.

13. The communication apparatus of claim 12, wherein the base material for the multi-layer printed circuit board has a dielectric constant value that is greater than air.

14. The communication apparatus of claim 13, wherein the integration of the first set of conductive elements and the second set of conductive elements within the base material for the multi-layer printed circuit board operates to reduce the physical size of the antenna for a given frequency of electrical operation.

15. The communication apparatus of claim 9, wherein the capacitive coupling reduces the physical size of the antenna for a given frequency of electrical operation.

16. The communication apparatus of claim 9, wherein the antenna is used at an electrical frequency that is less than or equal to 2.5 gigahertz.

17. A method for fabricating an antenna structure comprising:

forming a first portion of an antenna structure on a first inner layer of a multi-layer printed circuit board using a first set of conductive elements comprising a first radiator arm, a first shorting arm and a feeder arm, forming a second portion of the antenna structure on a second inner layer of the multi-layer printed circuit board using a second set of conductive elements such that the second set of conductive elements are in parallel with the first set of conductive elements, said second set of conductive elements comprising a second radiator arm and a second shorting arm, the first set of conductive elements and the second set of conductive elements being included in an inverted f antenna;

separating the first and second inner layers with a material region disposed there between; and positioning outer material regions around the first and second inner layers, each outer material region having an outer conductive layer disposed thereon;

forming a first conductive around plane on the first layer of the multi-layer printed circuit board;

forming a second conductive around plane on the second layer of the multi-layer printed circuit board such that the second conductive ground plane is in parallel with the first conductive ground plane; and forming a plurality of conductive vias to connect together the first conductive ground plane and the second conductive ground plane, wherein a portion of the first conductive around play and a portion of the second conductive ground plane are capacitively coupled respectively to a portion of the first radiator arm and a portion of the second radiator arm.

18. The method of claim 17, herein the second set of conductive elements are formed as a mirror image of the first set of conductive elements.

19. The method of claim 17, further comprising forming a plurality of conductive vias to connect the first set of conductive elements to the second set of conductive elements.

20. The method of claim 17, wherein the material regions comprise a base material for the multi-layers circuit board, the first set of conductive elements and the second set of conductive elements being integrated within the base material.

21. The method of claim 20, wherein the base material for the multi-layer printed circuit board has a dielectric constant value that is greater than air.

22. The method of claim 21, wherein the integration of the first set of conductive elements and the second set of conductive elements within the base material for the multi-layer printed circuit board operates to reduce the physical size of the antenna structure for a given frequency of electrical operation.

23. The method of claim 17, wherein the capacitive coupling reduces the physical size of the antenna structure for a given frequency of electrical operation.

24. The method of claim 17, wherein the antenna structure is used at an electrical frequency that is less than or equal to 2.5 gigahertz.

* * * * *